United States Patent [19]

Okazaki

[11] Patent Number: 4,461,741

[45] Date of Patent: Jul. 24, 1984

[54] CHROMIUM AND COBALT FREE NICKEL BASE SUPERALLOY POWDER

[75] Inventor: Kenji Okazaki, Rockaway Township, Morris County, N.J.

[73] Assignee: Allied Corporation, Morris Township, Morristown, N.J.

[21] Appl. No.: 335,931

[22] Filed: Dec. 30, 1981

[51] Int. Cl.[3] ..... C22C 19/03

[52] U.S. Cl. ..... 420/460; 75/246

[58] Field of Search ..... 420/460; 148/426, 429, 148/409; 75/246

[56] References Cited

U.S. PATENT DOCUMENTS 4,297,135 10/1981 Giessen et al. ..... 148/426

4,359,352 11/1982 Ray et al. ..... 148/409

*Primary Examiner*—R. Dean

*Attorney, Agent, or Firm*—Gus T. Hampilos; Michael J. Weins; Gerhard H. Fuchs

[57] ABSTRACT

Rapidly solidified chromium and cobalt free superalloy powders are described. The compositions of the alloys are as follows:

$$Ni_{Bal}Al_aTi_bNb_cHf_dMo_eZr_fB_g$$

where the subscripts of the elemental additions are atomic percents and have the following values;

a=10–15
b=3–10
c=0–4
d=0–4
e=0–4
f=0–1
g=2–5

These alloys maintain their strength at temperatures in excess of 800° C. and show excellent oxidation resistance.

4 Claims, 2 Drawing Figures

CHROMIUM AND COBALT FREE NICKEL BASE SUPERALLOY POWDER

DESCRIPTION

The present invention relates to chromium and cobalt free nickel base superalloys produced by rapid solidification, and to articles produced therefrom.

BACKGROUND OF THE INVENTION

Conventional nickel base superalloys are based on nickel with additions of aluminum and other elements to form a gamma prime strengthening phase. The microstructure of nickel base superalloys consists of a gamma matrix (a nickel solid solution) containing 15% to about 60% by volume of the gamme prime phase. The gamma prime phase is an ordered compound based on $Ni_3Al$. Other alloy additions may be made to the basic superalloy for strengthening and/or stability of the microstructure. Titanium is often added and acts interchangeably with aluminum as a gamma prime former. Chromium is commonly added to improve oxidation resistance. Refractory metals such as molybdenum, tungsten, tantalum, and columbium may be added for solid solution strengthening. Cobalt is often added to control the gamma prime solvus temperature and improve the hot workability.

U.S. Pat. No. 4,226,644 teaches that cobalt free rapidly solidified superalloy powders having high concentrations of both aluminum and chromium can be consolidated to form articles with excellent oxidation resistance.

SUMMARY OF THE INVENTION

The present invention relates to a rapidly solidified superalloys with compositions consisting essentially of the formula:

$$Ni_{Bal}Al_{10-15}Ti_{3-10}Nb_{0-4}Hf_{0-4}Mo_{0-4}Zr_{0-1}B_{2-5} \quad [1]$$

where the subscripts are the atomic percents of the elements.

Superalloys conforming to the above composition limits can be solidified at a rate greater than about $10^{5°}$ C./sec to produce filaments, ribbons, shard or powder. The term particulate will be used to represent all forms of the rapidly solidified product. Particulate with the composition of the present invention can be consolidated to form chromium and cobalt free superalloy articles which have excellent oxidation resistance, and which maintain their strength at elevated temperatures.

BEST MODE FOR CARRYING THE INVENTION INTO PRACTICE

The superalloys of the present invention differ from prior art superalloys in several respects. They contain 2–5 atomic percent boron which is substantially more than conventional superalloys, and are without additions of cobalt and chromium. Additions of boron and titanium are felt to aid in the formation of complex borides which supplement the gamma prime strengthening and provide additional matrix strengthening. Rapidly solidified superalloys, having compositions which conform to the limits set forth in formula [1], do not have their physical properties degraded by thermal cycling to temperatures as high as about 800° C.

When harder superalloys with higher temperature stability are sought, the composition is preferably further restricted to the following composition limits:

$$Ni_{Bal}Al_{10-15}Ti_{3-10}Nb_{0-4}Hf_{0-4}Mo_{0-4}Zr_{0-1}B_{3-5} \quad [2]$$

with the proviso that the sum of the Nb, Hf, and Zr additions be at least 2 atomic percent. These superalloys are stable to temperatures as high as about 1000° C.

A series of superalloy compositions within, as well as outside, the scope of the present invention were cast as ribbons. The ribbons were jet cast on a Cu-Be wheel. The surface speed of the casting surface was maintained between about 4000 ft/min (2,032 cps) and 6000 ft/min (3,048 cps). Segments of each composition of the ribbons were aged for 4 hours at selected temperatures. The hardness versus aging temperature is plotted in FIG. 1, and the key for the data points is summarized in Table 1. The superalloy compositions fall within three groups as is illustrated by the bands in FIG. 1.

TABLE 1

| Alloy | Composition | Formulas Applicable |
|---|---|---|
| 1 | $Ni_{73}Al_{15}Ti_3Nb_2Hf_2Zr_1B_4$ | 1 and 2 |
| 2 | $Ni_{73}Al_{15}Ti_3Hf_3Mg_2Zr_1B_4$ | 1 and 2 |
| 3 | $Ni_{76}Al_{15}Ti_3Hf_2B_4$ | " |
| 4 | $Ni_{79}Al_{10}Ti_5Nb_2B_4$ | 1 |
| 5 | $Ni_{81}Al_{10}Ti_5B_4$ | " |
| 6 | $Ni_{76}Al_{15}Ti_3Mo_2B_4$ | " |
| 7 | $Ni_{82}Al_{10}Ti_5Nb_1B_2$ | " |
| 8 | $Ni_{78}Al_{15}Ti_3B_4$ | " |
| 9 | $Ni_{83}Al_{10}Ti_5B_2$ | " |
| 10 | $Ni_{79}Al_{15}Ti_2B_4$ | Neither 1 or 2 |
| 11 | $Ni_{82}Al_{15}Ti_1B_2$ | " |
| 12 | $Ni_{87}Al_{10}Ti_1B_2$ | " |
| 13 | $Ni_{89}Al_5Ti_2B_4$ | " |
| 14 | $Ni_{84}Al_{10}Ti_2B_4$ | " |
| 15 | $Ni_{92}Al_5Ti_1B_2$ | " |

Figure 1:
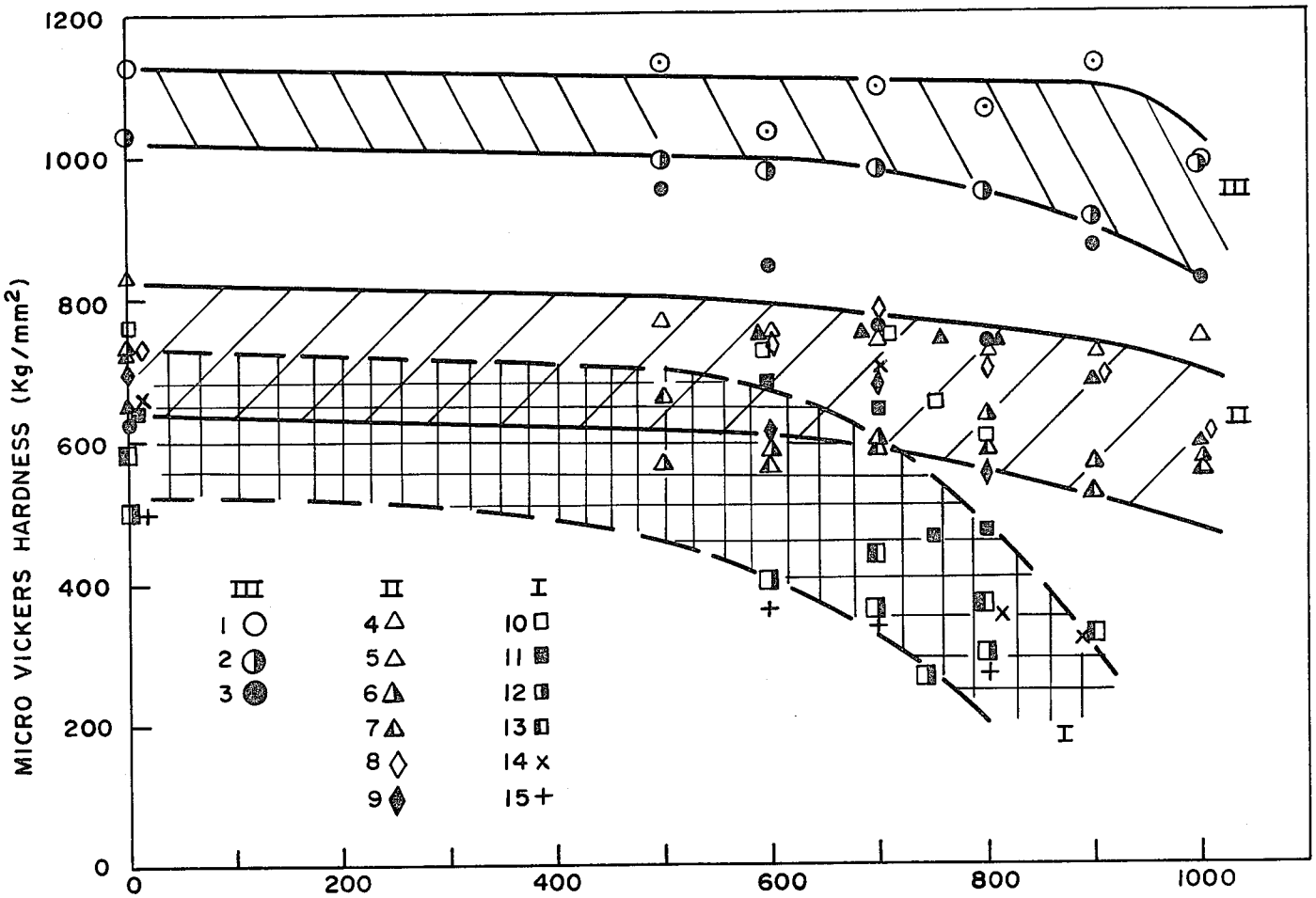
FIG. 1 is a plot of hardness as a function of annealing temperature for various nickel-aluminum-boron alloys. Alloys within the scope of the invention are represented by bands II and III while alloys outside the invention are represented by band I.

Referring to Table 1 and FIG. 1 it can be seen that the superalloy compositions outside the present invention fall within the first band I.

Generally as the titanium and aluminum levels increase, the temperature range over which the structure is thermally stable increases. The alloys with the higher titanium and aluminum compositions defined by formula [1] form a second band, II in FIG. 1. When the additional elements of Nb, Hf and Zr are added, there is a substantial increase in the hardness, and an improvement in the thermal stability. Superalloys falling within the third band, III of FIG. 1, have compositions which fall within the limits of formula [2].

Rapidly solidified superalloys of the present invention may be produced by a variety of techniques such as atomization, splat quenching, jet casting of filament or ribbon, or planar flow ribbon casting. If desired, the ribbon may be subsequently pulverized to produce powder. All of the above techniques for producing the rapidly solidified alloy are capable of providing solidification rates greater than about $10^{5°}$ C./sec. The preferred method is to form rapidly quenched ribbon by jet casting onto a water cooled wheel. This technique provides cooling rates as high as about $10^{6°}$ C./sec.

The above superalloy may be used to produce articles of manufacture by having the particulate consolidated by a standard consolidcation technique such as extruding or hot isostatic pressing.

In order to illustate the advantages of these superalloys, the following example is offered.

EXAMPLE

A superalloy of the composition $Ni_{73}Al_{1.5}Ti_3Nb_2Hf_2Zr_1B_4$ was jet cast onto a Cu-Be wheel having a surface velocity of about 4000 ft/min (2032 cm/sec). The jet casting produced a ribbon which was subsequently pulverized by ball-milling to produce a powder of less than 60 mesh. The powder was then canned in evacuated cans which were hot isostatically pressed at 1050° C. for 2 hours at a pressure of 100 MPa. The resulting consolidated powder had 100% density.

The consolidated material was tested for hardness at selected temperatures. A plot of the hardness versus temperature is given by curve IV of FIG. 2.

Figure 2:
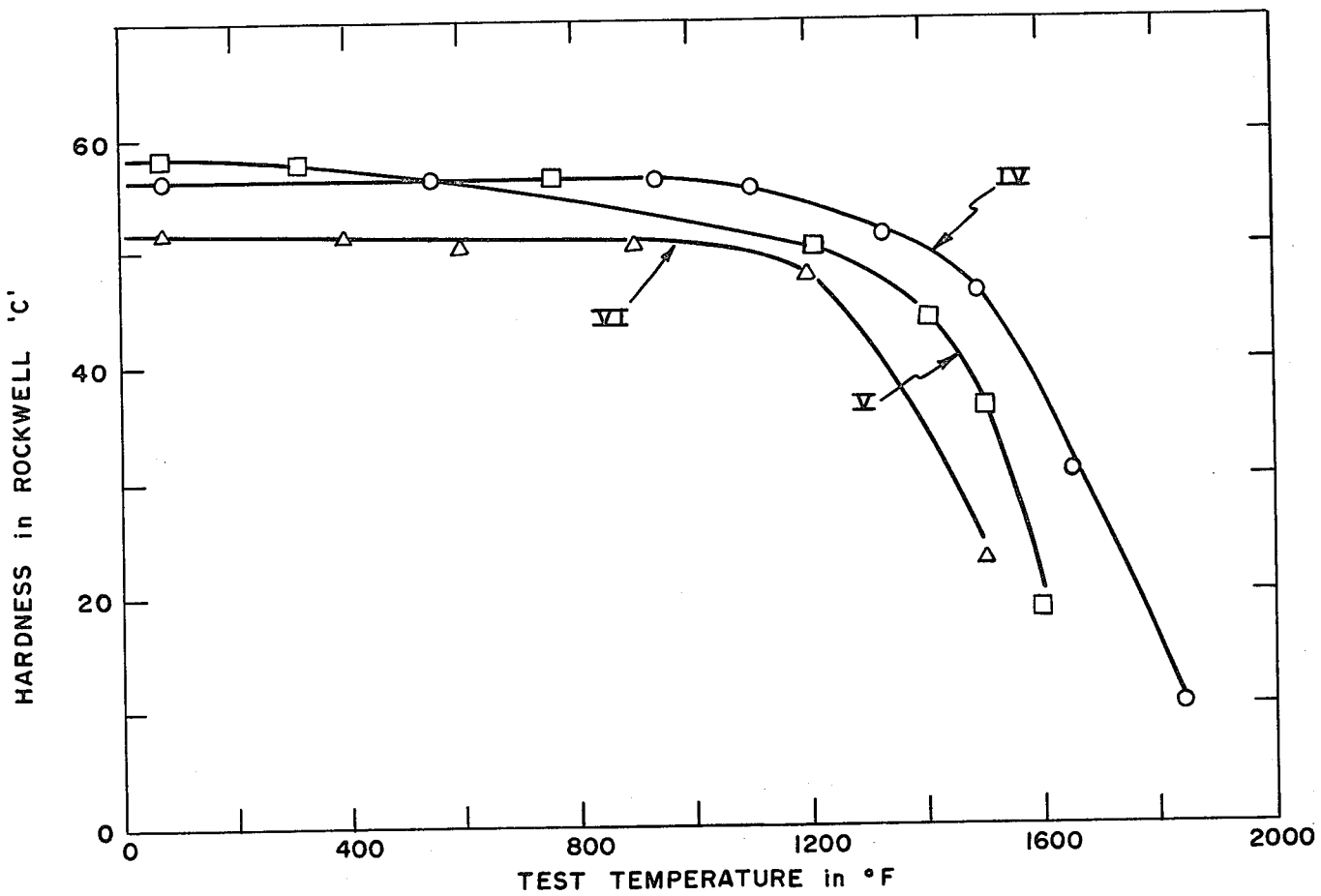
FIG. 2 is the plot of hardness as a function of temperature for various nickel base and cobalt base alloys.

Curve V of FIG. 2 shows comparative hardnesses for a cobalt base alloy having the following composition 44 Co, 33 Cr 17 W, 2.3 C and the balance essentially (Fe, Si, Ni, and Mn) in weight percents. This alloy is sold under the trade name Rexalloy 33 registered to Crucible Steel Company.

The temperature dependence of a nickel base alloy of consolidated powder is shown by curve VI of FIG. 2. The consolidated powder was processed by hipping as described in U.S. patent application No. 318,893 filed Nov. 11, 1981. The powder had the composition $Ni_{56.5}Fe_{10}Mo_{23.5}B_{10}$ where the subscripts are atomic percents.

As can be seen from FIG. 2, the superalloy of the present invention maintains its hardness to higher temperatures than comparative cobalt and nickel base alloys.

It should be pointed out that hardness generally scales with ultimate tensile strength. D. Taber reports in "Hardness of Metals", Clarendon Press, Oxford (1951) that an imperical relationship between hardness and tensile strength can be expressed as follows:

$$\text{Tensile Strength} = H/C$$

Where H is hardness in Vickers, and C is a coefficient characteristic of the material, and in the range of 2.8 and 4

The consolidated superalloy of the example has a VHN of 810 which corresponds to a tensile strength in excess of 200,000 psi (1,378,950 kPa). In view of the fact that the hardness remains high to about 800° C. (e.g. in excess of 1400° F.) for the alloy of the present invention, the alloy should maintain its strength to the test temperatures set forth in U.S. Pat. No. 4,140,528. It should be expected that the preferred superalloy will provide equivalent high temperature strength to those of the chromium and cobalt bearing superalloys such as Rene 95 reported in U.S. Pat. No. 4,140,528.

A test specimen 0.224 inch (0.569 cm) by 0.265 inch (0.673 cm) by 0.280 inch (0.711 cm) was cut from the hipped sample and tested for oxidation resistance. It was tested for 368 hours total hot time at a temperature of 1100° C. with the cycle of 23 hours hot and 1 hour cold. The resulting weight loss was 31.5 mg/cm$^2$ which is comparable to the weight loss of the chromium bearing alloy reported in U.S. Pat. No. 4,226,644.

What I claim is:

1. A superalloy which is solidified at rates greater than about 10$^5$° C./sec. having a composition consisting essentially of the formula:

$$Ni_{Bal}Al_aTi_bNb_cHf_dMo_eZr_fB_g$$

Where: the subscripts are the elemental additions in atomic percent and have the following values:

a=10–15
b=3–10
c=0–4
d=0–4
e=0–4
f=0–1
g=2–5

2. The superalloy of claim 1 wherein the boron addition is between 3 and 5 atomic percent, and the sum of the additions of Nb, Hf and Zr is at least 2 atomic percent.

3. The superalloy of claim 1 or 2 in powder form.

4. The superalloy of claim 1 or 2 in consolidated form.

* * * * *